US012302954B2

(12) United States Patent
Xu et al.

(10) Patent No.: US 12,302,954 B2
(45) Date of Patent: May 20, 2025

(54) DRESS WITH BODY-SHAPING FUNCTION

(71) Applicant: POPILUSH LLC, Williamsburg, VA (US)

(72) Inventors: Zhennan Xu, Fujian (CN); Huijuan Lin, Fujian (CN)

(73) Assignee: POPILUSH LLC, Williamsburg, VA (US)

( * ) Notice: Subject to any disclaimer, the term of this patent is extended or adjusted under 35 U.S.C. 154(b) by 94 days.

(21) Appl. No.: 17/870,001

(22) Filed: Jul. 21, 2022

(65) Prior Publication Data

US 2023/0404175 A1 Dec. 21, 2023

(30) Foreign Application Priority Data

Jun. 20, 2022 (CN) ..... 202221540970.7

(51) Int. Cl.
*A41C 1/06* (2006.01)
*A41C 3/08* (2006.01)
(Continued)

(52) U.S. Cl.
CPC ..... *A41C 1/06* (2013.01); *A41D 1/22* (2013.01); *A41B 2400/38* (2013.01); *A41C 3/08* (2013.01); *A41D 10/00* (2013.01); *A41D 2400/38* (2013.01)

(58) Field of Classification Search
CPC .... A41C 1/06; A41C 1/14; A41C 1/22; A41B 2400/38; A41B 9/08; A41D 2400/38; A41D 10/00
(Continued)

(56) References Cited

U.S. PATENT DOCUMENTS 2,115,833 A * 5/1938 Watinsky ..... A41D 7/00 D2/735
2,118,958 A * 5/1938 Watinsky ..... A41D 7/00 D2/735
(Continued)

FOREIGN PATENT DOCUMENTS

CN 200953842 Y 10/2007
CN 203040708 U 7/2013
(Continued)

OTHER PUBLICATIONS

"Spandex Power Mesh Heavy Weight Black." Boo! Designs. Sep. 18, 2010. https://boodesigns.com.au/products/spandex-power-mesh-heavy-weight-black (Year: 2010).*
(Continued)

*Primary Examiner* — Grace Huang
(74) *Attorney, Agent, or Firm* — Kaufman & Canoles, P.C.

(57) ABSTRACT

A dress with a body-shaping function comprises: an outer dress composed of a dress body and straps connected to a collar of the dress body; and a body-shaper lining located inside the dress body and completely covered by the dress body, wherein a top end of the body-shaper lining is sewn or bonded on the dress body along the collar of the dress body, and the body-shaper lining is of a jumpsuit structure and has at least one body-shaping area. The joint of the body-shaper lining on the outer dress can be hidden, and no obvious bonding trace will be seen from the appearance of the outer dress; and the dress body can be held by means of the tension of the body-shaper lining next to the skin and the suspension effect of the straps.

13 Claims, 7 Drawing Sheets

(51) Int. Cl.
*A41D 1/22* (2018.01)
*A41D 10/00* (2006.01)

(58) Field of Classification Search
USPC ..... 2/69, 69.5, 71, 74, 78.2, 95, 105, 304, 2/915; 450/95, 153
See application file for complete search history.

(56) References Cited

U.S. PATENT DOCUMENTS 2,290,954 A * 7/1942 Fox ..... A41C 3/08 2/73
2,548,143 A * 4/1951 Christiansen ..... A41B 9/00 D2/714
3,771,172 A * 11/1973 Barg ..... A41D 7/00 2/912
3,771,712 A * 11/1973 Richards ..... B65D 85/324 206/521.1
5,054,129 A * 10/1991 Baehr ..... A41B 11/004 2/242
5,075,902 A * 12/1991 McReynolds ..... A63B 21/065 2/238
5,094,648 A * 3/1992 Turner ..... A41C 1/10 2/73
5,255,393 A * 10/1993 Brady ..... A41B 9/14 450/131
5,915,531 A * 6/1999 Hilpert ..... A41D 1/21 450/155
5,956,765 A * 9/1999 Chin ..... A41D 7/00 2/78.2
7,685,651 B2 * 3/2010 Yoo ..... A41C 1/003 2/403
7,922,682 B2 4/2011 Bell et al.
7,950,069 B2 * 5/2011 Lee ..... A41D 27/26 2/227
8,376,808 B2 * 2/2013 Hopkins ..... A41C 3/08 450/33
8,647,168 B2 * 2/2014 Anvaripour ..... A41C 1/003 450/74
9,198,467 B2 12/2015 Gordon
9,867,411 B2 * 1/2018 Gallagher ..... A41D 19/001
10,058,131 B2 * 8/2018 Solano ..... A41B 11/00
10,278,431 B2 5/2019 Mcclean
10,426,649 B2 * 10/2019 Lyu ..... A41B 9/005
10,555,562 B2 * 2/2020 Poirier ..... A41D 27/24
10,555,564 B2 * 2/2020 Brady ..... A41B 9/005
10,701,985 B2 * 7/2020 Cano ..... A41B 9/08
10,888,127 B2 1/2021 Shir et al.
11,612,190 B2 * 3/2023 Webb ..... A41D 1/04 2/115
2002/0078591 A1 * 6/2002 Morrone ..... A43B 5/12 36/102
2003/0110551 A1 * 6/2003 Lazarian ..... A41C 1/003 2/409
2007/0050879 A1 * 3/2007 Etzold ..... A41D 27/28 2/69
2008/0244805 A1 * 10/2008 Griffin ..... A41D 1/22 450/95
2008/0256676 A1 * 10/2008 Di Lorenzo ..... A41D 27/04 450/95
2010/0037368 A1 * 2/2010 Stearns ..... A41B 9/08 2/227
2011/0209262 A1 * 9/2011 Waldman ..... A41D 27/02 2/69
2013/0095730 A1 * 4/2013 Jensen ..... A41D 1/06 450/95
2013/0189900 A1 * 7/2013 Bloch Marco ..... A41C 3/00 450/93
2014/0165265 A1 * 6/2014 Tulin ..... A41D 1/06 2/234
2015/0208734 A1 * 7/2015 Callahan ..... A41D 1/22 450/30
2016/0235130 A1 * 8/2016 Fanger ..... A41D 10/00
2019/0075853 A1 * 3/2019 Altmann ..... D04B 1/104
2019/0082751 A1 * 3/2019 Young ..... D06M 15/507
2019/0191791 A1 * 6/2019 Patterson ..... A41F 17/00
2019/0274365 A1 * 9/2019 Patterson ..... A41B 9/06
2020/0229516 A1 * 7/2020 Curran ..... A41D 1/06
2021/0106455 A1 * 4/2021 McKeown ..... A61F 5/56
2021/0338473 A1 * 11/2021 Woodruff ..... A41D 13/1254
2022/0047005 A1 * 2/2022 Arciuolo ..... A41B 11/003
2022/0151308 A1 * 5/2022 Penfield ..... A41C 1/003

FOREIGN PATENT DOCUMENTS

DE 1435887 A1 * 2/1969 ..... A41B 9/00
EP 3838036 B1 9/2022
KR 20090100730 A * 9/2009 ..... A41C 1/00

OTHER PUBLICATIONS

Shaper Dress Bodycon Slip Dress Build in Shapewear Bra 8 in 1 Woman Sleeveless Casual Dress https://www.amazon.co.uk/Shaper-Bodycon-Shapewear-Sleeveless-Dresses/dp/B0CDLKQNGZ.

* cited by examiner

DRESS WITH BODY-SHAPING FUNCTION

CROSS REFERENCE TO RELATED APPLICATION

This application claims priority benefit of Chinese Utility Model Application No. 202221540970.7, filed on Jun. 20, 2022, and the entire contents of which are incorporated herein by reference.

BACKGROUND OF THE INVENTION

Technical Field

The invention belongs to the technical field of clothes, and particularly relates to a dress with a body-shaping function.

Description of Related Art

Dresses, which comprise an upper garment and a lower skirt connected to the upper garment, are fashionable and elegant, thus being extremely popular with all females, particularly young ladies pursuing fashion. However, on the one hand, the dresses have high requirements for the figure of wearers, and are typically of fixed sizes, which cannot be freely adjusted according to the body size of different wearers; and on the other hand, some wearers who fail to keep a good figure or are in the special postpartum period cannot put on satisfactory dresses.

To highlight the body curve of females, various products such as body-shaping vests or body-shaping pants are developed in the clothing industry, and are typically composed of a main part made of an elastic fabric and used for lacing the body, and the sewing position and the sewing direction are designed to improve the body lacing and shaping effect of the products. For example, the body-shaping vests have a good shaping effect on the ribs on the sides of the body and the belly; and the body-shaping pants focus on hip lifting and belly lacing, and lace the fat of wearers to create an elegant body curve, such as Chinese Patent Publication No. CN200953842Y and Chinese Patent Publication No. CN203040708U.

However, dresses with a body-shaping function are not available yet on the market. To meet the requirement for a sense of beauty, wearers have to wear a body-shaping vest or a pair of body-shaping pants and then wear the dress to hide the body-shaping vest or the body-shaping pants inside.

BRIEF SUMMARY OF THE INVENTION

The objective of the invention is to provide a dress with a body-shaping function, which integrates a dress and a body-shaper lining to create an elegant body curve for wearers.

To fulfill the above objective, the technical solution adopted by the invention is as follows:

A dress with a body-shaping function comprises an outer dress and a body-shaper lining, wherein the outer dress is composed of a dress body and straps connected to a collar of the dress body, the body-shaper lining is located inside the dress body and is completely covered by the dress body, a top end of the body-shaper lining is sewn or bonded on the dress body along the collar of the dress body, and the body-shaper lining is of a jumpsuit structure and has at least one body-shaping area.

Preferably, the body-shaper lining comprises a breast protection part for covering breasts and a body-shaper part with the body-shaping area, a top end of a front side of the body-shaper part is sewn or bonded on the breast protection part along a lower side of the breasts, and a top end of the breast protection part and a top end of a back side of the body-shaper part are sewn or bonded on the collar of the dress body.

Preferably, the body-shaper part comprises a bottomwear portion such as a pair of pants located on a lower portion, and the pants are of a shorts structure, a briefs structure or a T-back structure.

Preferably, a crotch opening is formed in a crotch of the body-shaper part.

Preferably, the body-shaping area of the body-shaper part is made of an elastic fabric with lateral elasticity.

Preferably, the body-shaper part is formed by a front piece, a rear piece A and a rear piece B that are sewn together, the rear piece A and the rear piece B are sewn together along a midline of a back, left and right sides of the front piece are respectively sewn on the rear piece A and the rear piece B to form side seams, a lower portion of the front piece is sewn on a lower portion of the rear piece A and a lower portion of the rear piece B to form the pants, and the front piece, the rear piece A and the rear piece B are all made of elastic fabrics with lateral elasticity; and a bottom end of the breast protection part is sewn or bonded at a front end of the front piece, and left and right sides of the breast protection part are sewn or bonded on a side edge of an upper portion of the rear piece A and a side edge of an upper portion of the rear piece B respectively.

Preferably, the front piece and the inner piece, as well as the rear piece A and the rear piece B are connected through traceless sewing or traceless bonding.

Preferably, the pants are of a shorts structure and are provided with thigh girdle parts corresponding to thighs, and anti-skid epoxy materials are disposed on inner sides of bottoms of the thigh girdle parts.

Preferably, the body-shaper part further comprises an inner piece, the inner piece is located inside the front piece and is sewn or bonded on the front piece along a belly to form a double-layer belly binding part, and the inner piece is made of an elastic fabric with lateral elasticity.

Preferably, the front piece and the breast protection part are sewn together with an elastic thread.

Compared with the prior art, the invention has the following beneficial effects:

The dress provided by the invention comprises an outer dress and a body-shaper lining located inside the outer dress, and the body-shaper lining is sewn or bonded on a collar of the outer dress, so that the joint of the body-shaper lining on the outer dress can be hidden, and no obvious bonding trace will be seen from the appearance of the outer dress; and the dress body can be held by means of the tension of the body-shaper lining next to the skin and the suspension effect of straps. In addition, other portions of the body-shaper lining are separated from a dress body and are not fixed, so that the body-shaper lining can be cleaned easily, body shaping of target body-shaping areas is facilitated, the body-shaper lining can be put on by wearers easily, and the appearance of the outer dress will not be compromised.

The body-shaper lining is of a jumpsuit structure and has at least one body-shaping area, and the position of the body-shaping area can be designed as needed, so that the body-shaper lining can squeeze and bind fat in the corresponding area of the body of wearers to fulfill a body-shaping effect, and the body-shaper lining can well fit the body of the wearers to fulfill a body-shaping effect and is breathable.

A crotch opening is formed in a crotch of the body-shaper lining, so that wearers do no need to wear underpants anymore; and through the design of the crotch opening, wearers can relieve themselves directly without putting off the body-shaper lining and are free of inconvenience caused by putting on and off the body-shaper lining when relieving themselves.

REFERENCE SIGNS

10, outer dress; 11, dress body; 12, strap; 20, body-shaper lining; 21, breast protection part; 22, body-shaper part; 23, opening; 221, front piece; 222, rear piece A; 223, rear piece B; 224, inner piece.

DETAILED DESCRIPTION OF THE INVENTION

To gain a better understanding of the above features and advantages of the invention, the invention will be described in detail below with reference to embodiments and accompanying drawings.

Figure 1:
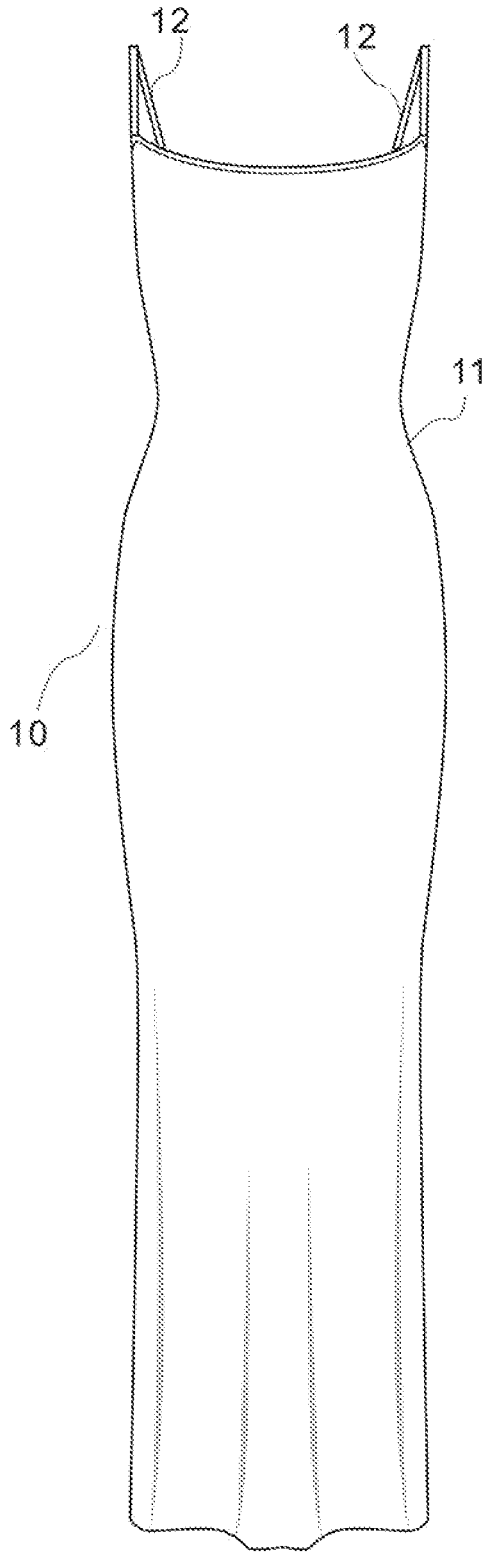
FIG. 1 is a structural diagram of an outer dress according to the invention.
Figure 2:
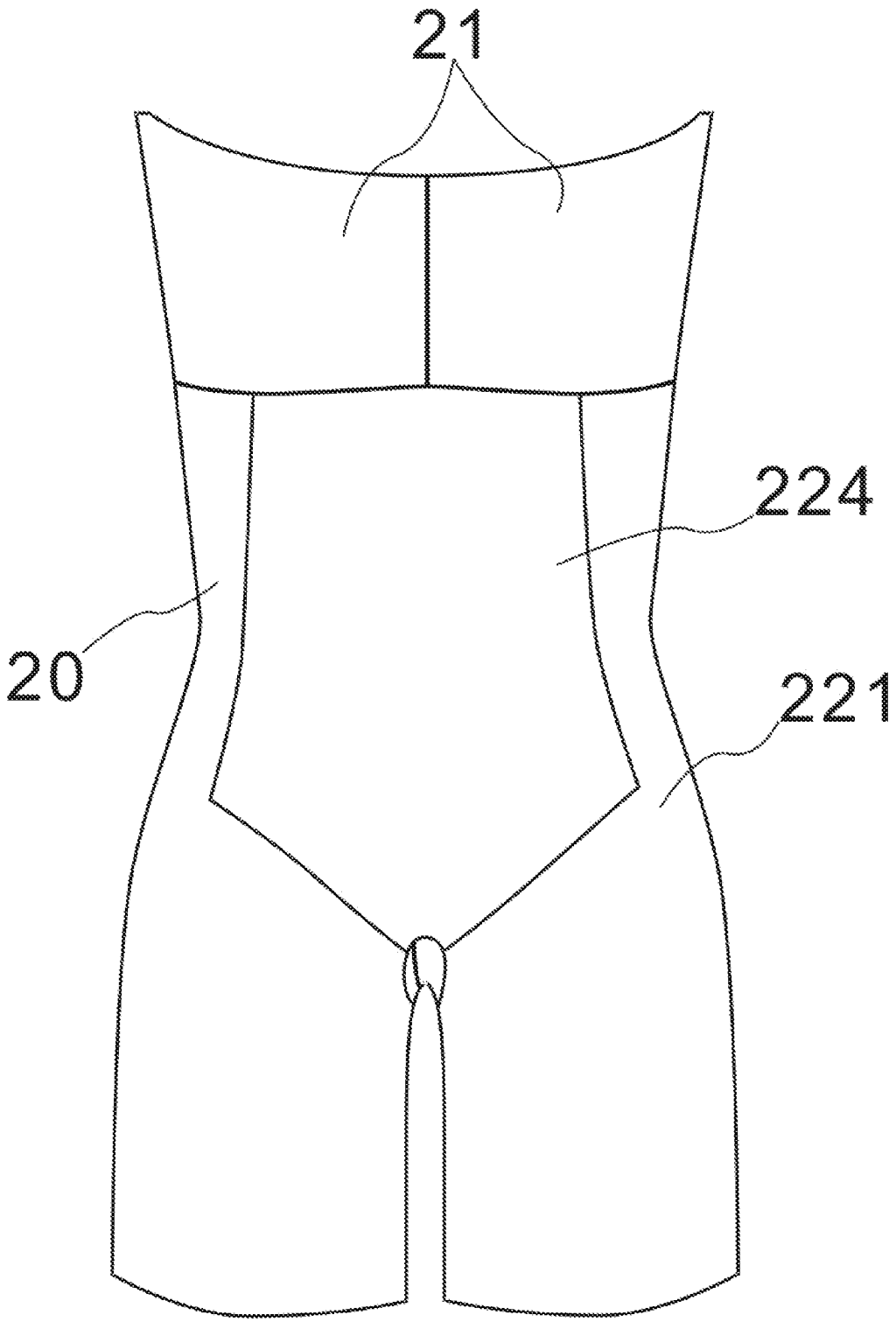
FIG. 2 is a structural diagram of the front side of a body-shaper lining according to the invention.
Figure 3:
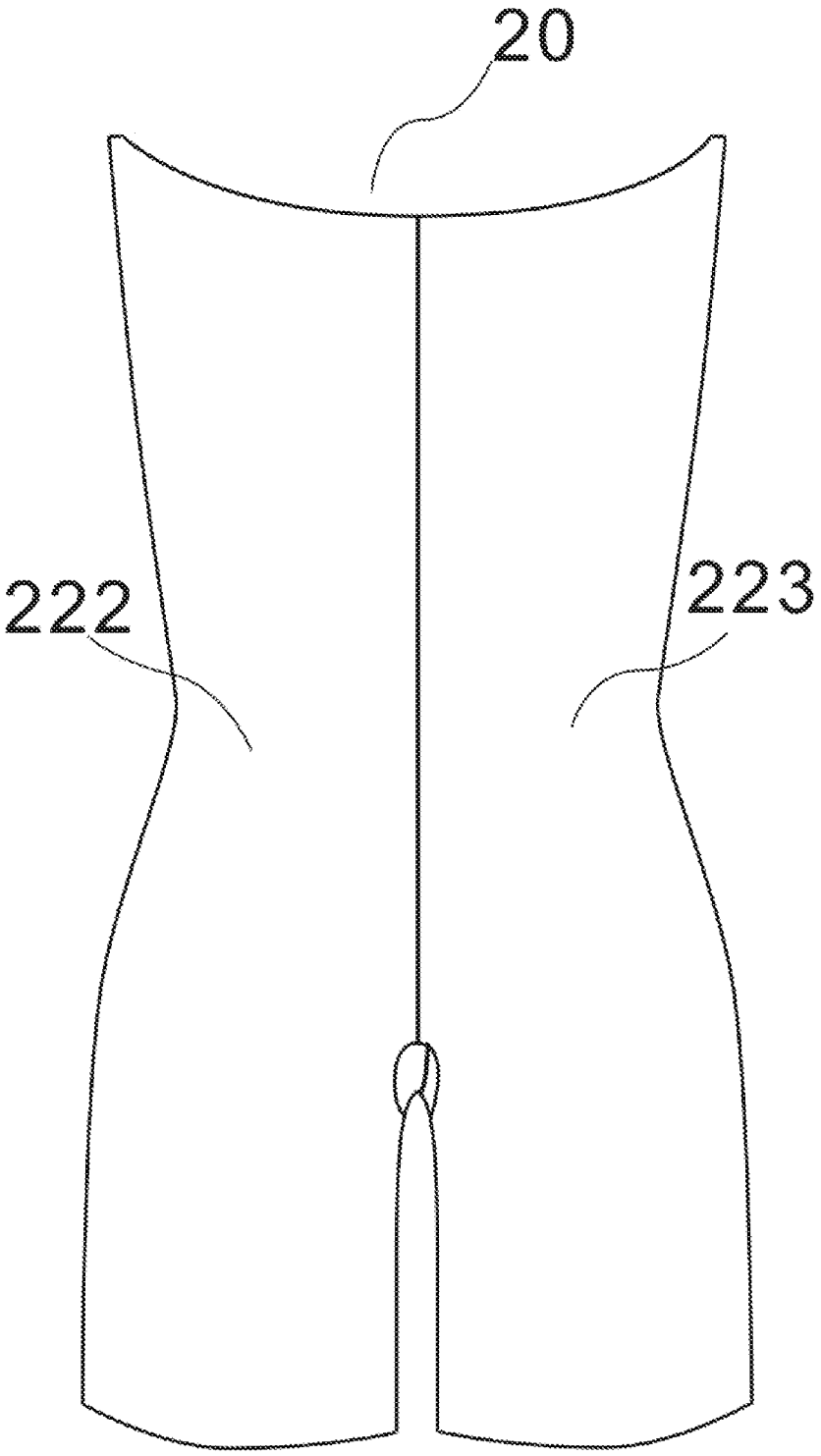
FIG. 3 is a structural diagram of the back side of the body-shaper lining according to the invention.
Figure 4:
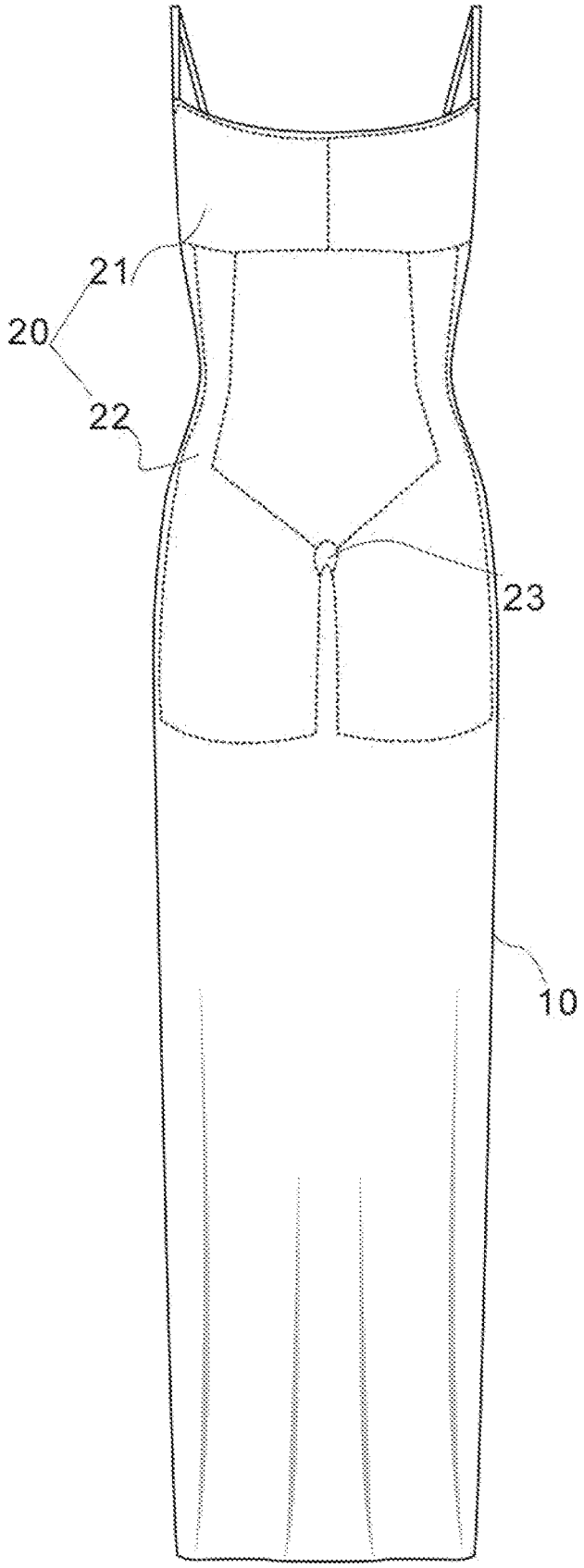
FIG. 4 is a perspective view of the front side of a preferred example of the dress according to the invention.
Figure 5:
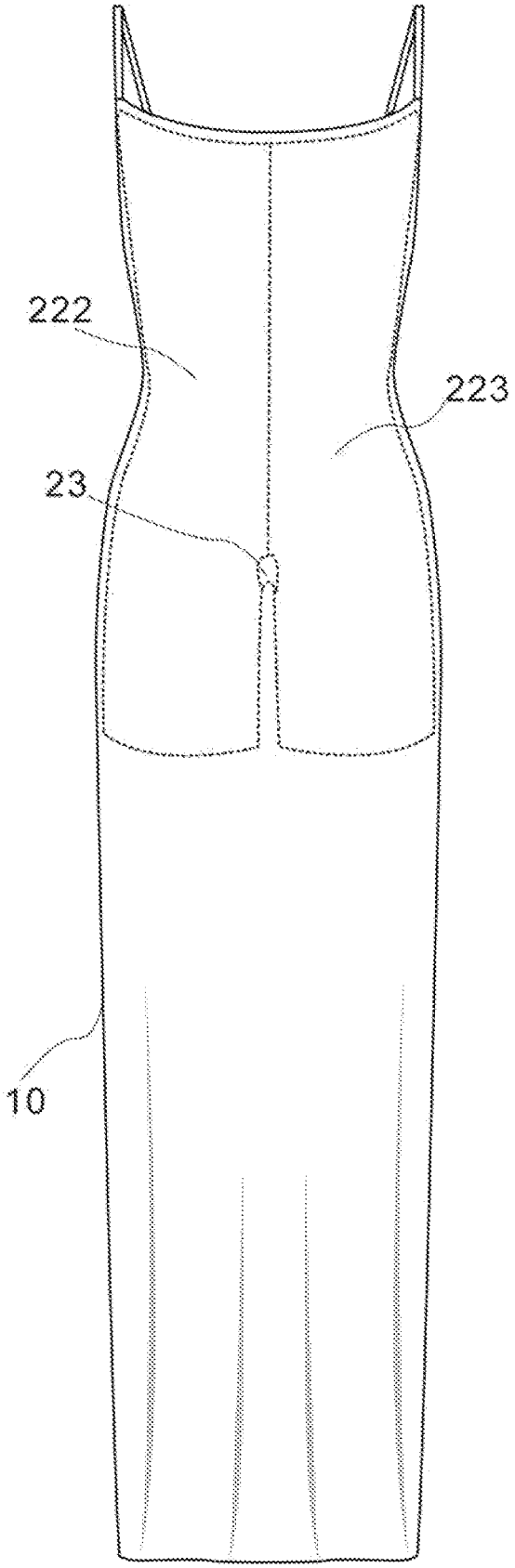
FIG. 5 is a perspective view of the back side of FIG. 4.
Figure 6:
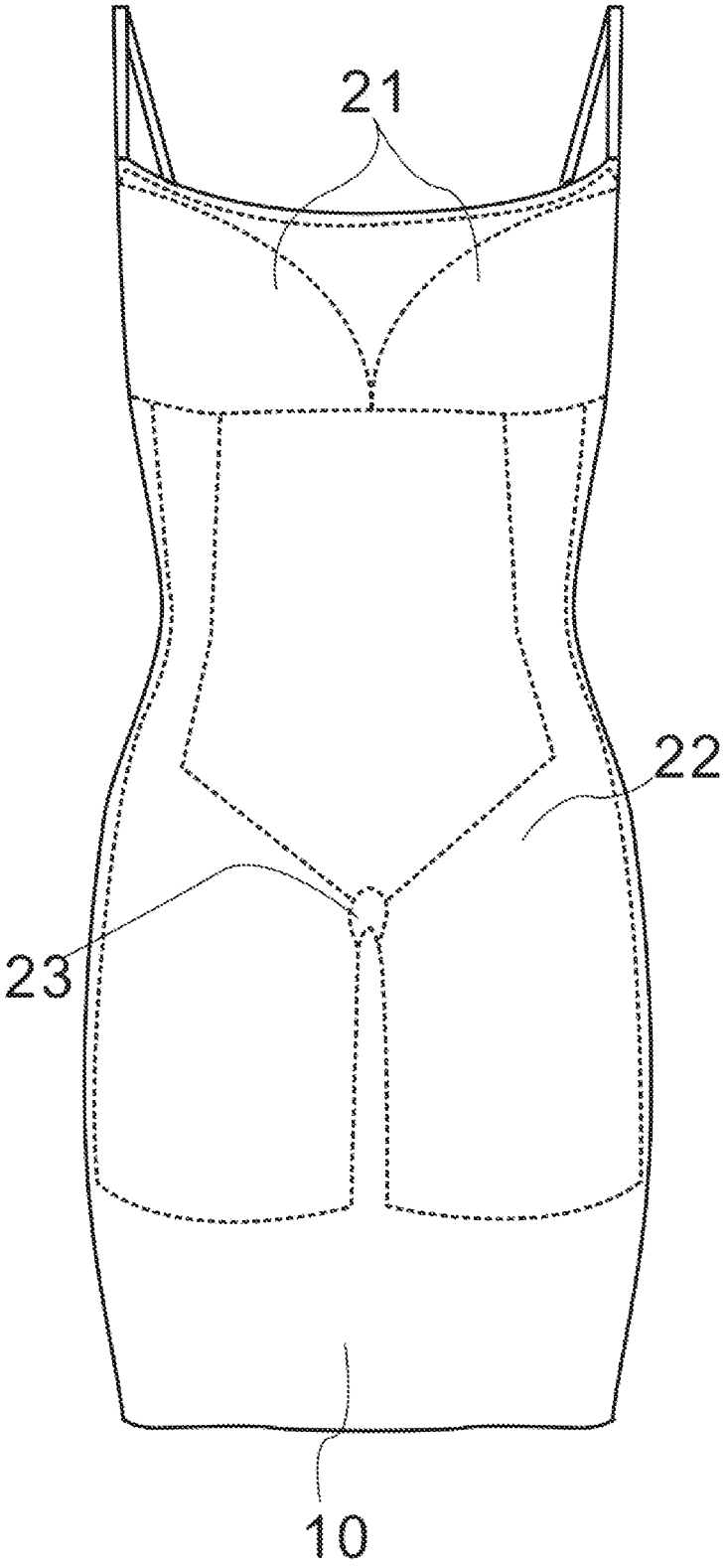
FIG. 6 is a perspective view of the front side of another preferred example of the dress according to the invention.
Figure 7:
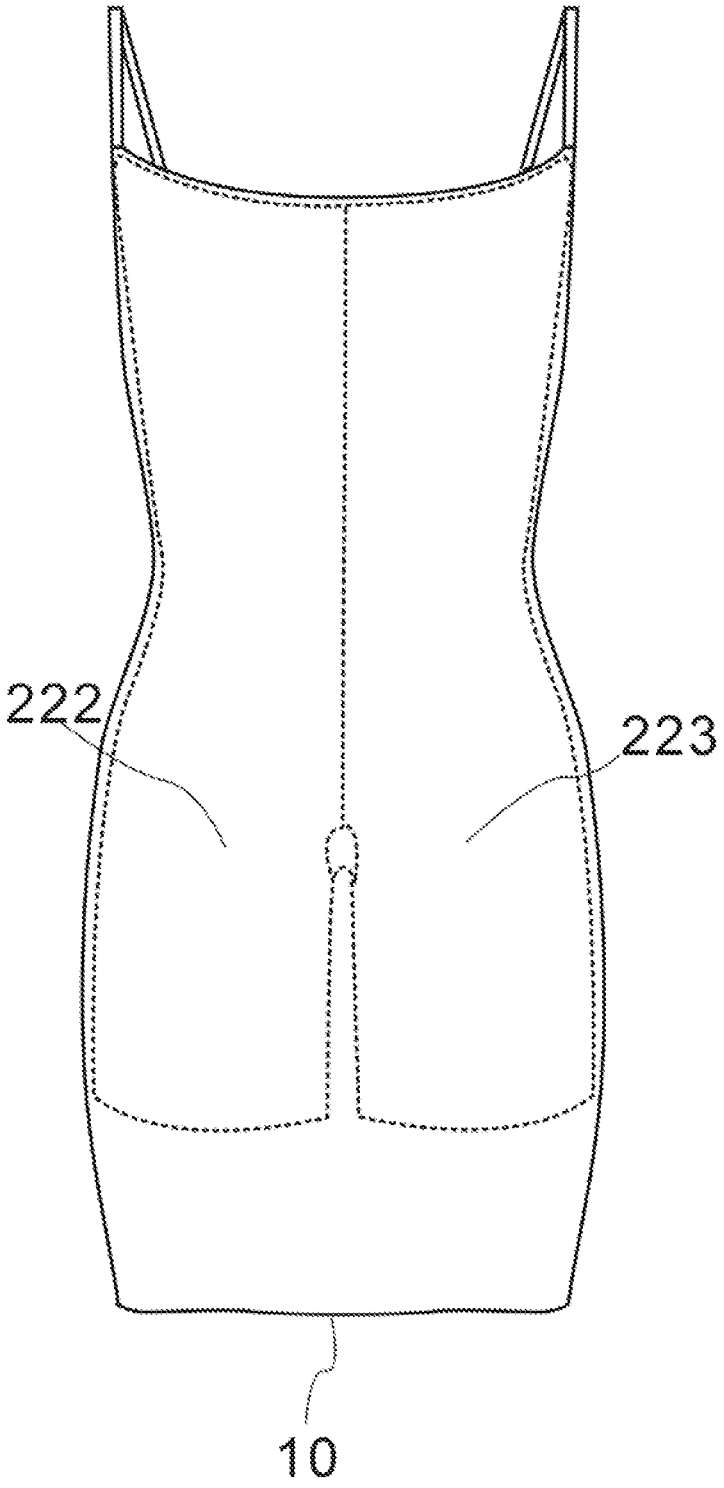
FIG. 7 is a perspective view of the back side of FIG. 6.

As shown in FIG. 1-FIG. 7, this embodiment provides a dress with a body-shaping function. The dress with a body-shaping function comprises an outer dress 10 and a body-shaper lining 20.

In this embodiment, the outer dress 10 is a double-strap slip dress composed of a dress body 11 and two straps 12 symmetrically disposed on a collar of the dress body 11, wherein the length of the straps 12 can be adjusted according to personal requirements; and a hemline can be designed to have different lengths, for example, the bottom of the hemline may reach the middle of the thighs, the knee joints or the anklebones; and the dress body 11 can completely cover the body-shaper lining 20, and after being worn by wearers, the dress body 11 droops naturally to cover the body-shaper lining 20. In some other embodiments, the straps 12 may be tied around the neck, that is, the outer dress 10 is a halter slip dress.

The dress body 11 may be made of common fabrics on the present market, and is preferably made of a polyester-elastane knitted fabric, a cotton-elastane knitted fabric or a modal knitted fabric. Wherein, the modal fabric is soft, smooth, skin-friendly, comfortable, good in drapability, high in dye-uptake, bright and rich in color, distinct in printing and color separation, capable of absorbing and releasing water molecules at a rate higher than that of pure cotton, and more breathable than pure cotton. The fabric is preferably of a 2*2 rib structure, thus having good elasticity and being not prone to edge curling when stretched laterally; and stitch wales are clear and plump in surface.

In this embodiment, the body-shaper lining 20 is located inside the dress body 11 and is completely covered by the dress body 11, and atop end of the body-shaper lining 20 is sewn or bonded on the dress body 11 along the collar of the dress body 11. By designing the joint of the body-shaper lining 20 and the dress body 11 on the collar, the joint of the body-shaper lining 20 on the outer dress 10 can be hidden, and no obvious bonding trace will be seen from the appearance of the outer dress 10; and the dress body 11 can be held by means of the tension of the body-shaper lining 20 next to the skin and the suspension effect of the straps 12. Other portions of the body-shaper lining 20 are separated from the dress body 11 and are not fixed, so that the body-shaper lining 20 can be selectively uncovered commencing at a bottom end of the body-shaper lining 20 so that the body-shaper lining 20 can be cleaned easily, body shaping of target body-shaping areas is facilitated, the body-shaper lining 20 can be put on by wearers easily, and the appearance of the outer dress 10 will not be compromised.

The body-shaper lining 20 is of a jumpsuit structure and comprises a bottomwear portion such as a pair of pants located on a lower portion, the pants are of a shorts structure, a briefs structure or a T-back structure, and the structure of the pants is designed as required. An opening 23 is formed in a crotch of the body-shaper lining 20, so that wearers do not need to wear underpants anymore. Through the design of the crotch opening 23, wearers can relieve themselves directly without taking off the body-shaper lining 20 and are free of inconvenience caused by putting on and taking off the body-shaper lining 20 when relieving themselves. Further, an anti-bacterial and skin-friendly fabric may be disposed at the opening 23.

As an example, the body-shaper lining 20 in this embodiment comprises a breast protection part 21 and a body-shaper part 22 with at least one body-shaping area. In this embodiment, the breast protection part 21 may be made of a cotton-elastane fabric and is internally provided with bra pads or is integrally provided with bras; the body-shaping area is made of an elastic fabric with lateral elasticity, such as a breathable cotton-elastane mesh fabric or cotton-elastane knitted fabric which has an elastic recovery rate of 85%-95% when laterally stretched with a constant force of 1N, and the breathable cotton-elastane mesh fabric has a body-shaping effect and is breathable. A top end of a front side of the body-shaper part 22 is sewn or bonded on the breast protection part 21 along the lower side of breasts, and a top end of the breast protection part 21 and a top end of a rear side of the body-shaper part 22 are sewn or bonded on the collar of the dress body 11. Preferably, the body-shaper lining 20 is sewn on the dress body 11 through single-stitch flat seaming or three-stitch over-seaming.

Specifically, the body-shaper part 22 is formed by a front piece 221, a rear piece A 222, a rear piece B 223 and an inner piece 224 that are sewn together, wherein the rear piece A 222 and the rear piece B 223 are sewed together along a midline of the back; left and right sides of the front piece 221 are respectively sewed on the rear piece A 222 and the rear piece B 223 to form side seams, and the bottomwear portion such as the pants of a shorts structure are formed on the lower portion; and a bottom end of the breast protection part 21 is sewn at a top end of the front piece 221, and left and right sides of the breast protection part 21 are sewn on a side edge of an upper portion of the rear piece A 222 and a side edge of an upper portion of the rear piece B 223 respectively. Preferably, the front piece 221 and the inner piece 224, as well as the rear piece A 222 and the rear piece B 223 are connected through seamless sewing or seamless bonding, so that the body-shaper inside can be worn with less traces. Areas, corresponding to the hip, of the rear piece A 222 and the rear piece B 223 are formed by 3D cutting, so that the hip curve will not be pressed.

The front piece 221, the rear piece A 222, the rear piece B 223 and the inner piece 224 are all made of elastic fabrics with lateral elasticity, such as breathable cotton-elastane mesh fabrics that have an elastic recovery rate of 85%-95% when laterally stretched with a constant force of 1N. A lower portion of the front piece 221, a lower portion of the rear piece A 222 and a lower portion of the rear piece B 223 are sewn together to form thigh girdle parts capable of effectively trimming the legs; and the inner piece 224 is located inside the front piece 221 and is sewn or bonded on the front piece 221 along the belly to form a double-layer belly binding part of a double-layer fabric structure, which has a better belly binding effect, can smoothen the curve, and is breathable and not sticky. In addition, the front piece 221 and the breast protection part 21 are sewn together with an elastic thread to fulfill a breast holding effect.

Multiple anti-skid epoxy materials are disposed on inner sides of bottoms of the thigh girdle parts and are spaced apart from each other vertically, so that the bottoms of the thigh girdle parts are less likely to slide upwards and are prevented from being sticky and uncomfortable. Memory bones may be disposed at top ends of the rear piece A 222 and the rear piece B 223 to prevent the top ends of the rear piece A 222 and the rear piece B 223 from curling and improve the support effect on the dress body 11.

The basic principle, main features and advantages of the invention are illustrated and described above. Those skilled in the art should understand that the invention will not be limited to the above embodiments, the above embodiments and the descriptions in this specification are merely used to explain the principle of the invention, different variations and improvements can be made to the invention without departing from the spirit and scope of the invention, and all these variations and improvements should fall within the scope of the invention claiming for protection. The protection scope of the invention is defined by the appended claims and their equivalents.

What is claimed is:

1. A dress with a body-shaping function, comprising:

an outer dress;

a body-shaper lining;

wherein the outer dress is composed of a dress body and straps connected to a collar of the dress body, the body-shaper lining is located inside the dress body and is completely covered by the dress body, the body-shaper lining is only coupled to the dress body along a top end of the body-shaper lining and the collar of the dress body to enable the body-shaper lining to be selectively uncovered commencing at a bottom end of the body-shaper lining so that the body-shaper lining can be exposed to facilitate cleaning and putting on the body-shaper lining, and the body-shaper lining is of a jumpsuit structure;

wherein the body-shaper lining includes a bust protection part configured for a breast area of a wearer of the dress and a body-shaper part configured for abdominal, pelvis, hip, thigh, back and buttocks areas of the wearer, with a top end of a front side of the body-shaper part being coupled to a lower side of the bust protection part, and a top end of the bust protection part and a top end of the back side of the body-shaper part being coupled to the collar of the dress body;

wherein the body-shaper part is further configured with a single front piece coupled to both a single first rear piece and a single second rear piece, with the first and second rear pieces being coupled along a midline that extends vertically along a center of a back portion of the body-shaper part from the top end of the back portion of the body-shaper part to a crotch area of the wearer, left and right outer sides of the front piece are coupled to outer sides of the first and second rear pieces to form outer side seams that extend to the thigh area of the wearer and inner sides of a lower portion of the front piece are coupled to inner sides of a lower portion of the first and second rear pieces to form inner side seams that extend from the crotch area to the thigh area of the wearer such that a bottomwear portion of the jumpsuit structure is formed, and the front piece and the first and second rear pieces are composed of elastic fabric having lateral elasticity; and wherein the body-shaper part further includes an inner piece composed of the elastic fabric and overlaid on the front piece about the abdominal and pelvis areas of the wearer, with the inner piece being configured with a tapering effect from the hip area to the pelvis area of the wearer.

2. The dress with the body-shaping function according to claim 1, wherein the bottomwear portion has a shorts structure, a briefs structure or a T-back structure.

3. The dress with the body-shaping function according to claim 1, wherein the front piece, the inner piece, and the first and second rear pieces are coupled by traceless sewing or traceless bonding.

4. The dress with the body-shaping function according to claim 1, wherein the bottomwear portion of the jumpsuit structure is of a shorts structure and is provided with thigh girdle parts configured for thigh areas of the wearer of the dress, and anti-skid epoxy materials are disposed on inner sides of a bottom portion of each thigh girdle part.

5. The dress with the body-shaping function according to claim 1, wherein the inner piece overlaid on the front piece forms a double-layer abdominal binding part.

6. The dress with the body-shaping function according to claim 1, wherein the front piece and the bust protection part are sewn together with an elastic thread.

7. The dress with the body-shaping function according to claim 1, wherein at least a portion of the body-shaper lining configured for the crotch area of the wearer of the dress is composed of anti-bacterial fabric.

8. The dress with the body-shaping function according to claim 1, wherein at least a portion of the elastic fabric have an elastic recovery rate in a range of eighty-five percent (85%) to ninety-five percent (95%) when laterally stretched with a constant force of one Newton (1N).

9. A garment, comprising:

an outer layer; and a body shaping layer having a set of body shaping elastic fabric pieces configured for chest, abdominal, pelvis, hip, thigh, back and buttocks areas of a wearer of the garment, the set of body shaping elastic fabric pieces includes a single front elastic fabric piece coupled to both a single first back elastic fabric piece and a single second back elastic fabric piece and being composed of elastic fabric having an elastic recovery rate in a range of eighty-five percent (85%) to ninety-five percent (95%) when laterally stretched with a constant force of one Newton (1N), the body shaping layer being disposed within the outer layer, the body shaping layer being only coupled to the outer layer along a top end of the body shaping layer and a top end of the outer layer to enable the body shaping layer to be selectively uncovered commencing at a bottom end of the body shaping layer so that the body shaping layer can be exposed to facilitate cleaning and putting on the body shaping layer; and wherein the set of body shaping elastic fabric pieces further includes an overlay body shaping elastic fabric piece being composed of the same elastic fabric as the front elastic fabric piece and first and second back elastic fabric pieces, and that overlays the front elastic fabric piece about the abdominal and pelvis areas of the wearer of the body shaping layer, with the overlay body shaping elastic fabric piece being configured with a tapering effect from the hip area to the pelvis area of the wearer.

10. The garment of claim 9, wherein the set of body shaping elastic fabric pieces includes a first elastic fabric piece configured for a bust area of the wearer of the garment.

11. The garment of claim 9, wherein the first and second back elastic fabric pieces are coupled along a vertical midline that extends vertically along a center of a back portion of the body shaping layer from the top end of the back portion of the body shaping layer to a crotch area of the wearer, with left and right outer sides of the front elastic fabric piece being respectively coupled to outer sides of the first and second back elastic fabric pieces to form outer side seams that extend to the thigh area of the wearer and inner sides of a lower portion of the front piece are coupled to inner sides of a lower portion of the first and second rear pieces to form inner side seams that extend from the crotch area to the thigh area of the wearer such that a bottomwear portion of the body shaping layer is formed, the set of body shaping elastic fabric pieces further includes a bust elastic fabric piece with a lower portion of the bust elastic fabric piece being coupled to an upper portion of the front elastic fabric piece and left and right sides of the bust elastic fabric piece being respectively coupled to an upper portion of a side of each of the first and second back elastic fabric pieces.

12. A body shaping layer, comprising:

a set of body shaping elastic fabric pieces configured for chest, abdominal, pelvis, hip, thigh, back and buttocks areas of a wearer of the body shaping layer, the set of body shaping elastic fabric pieces being composed of elastic fabric having an elastic recovery rate in a range of eighty-five percent (85%) to ninety-five percent (95%) when laterally stretched with a constant force of one Newton (1N), the set of body shaping elastic fabric pieces includes a single front elastic fabric piece coupled to a first single back elastic fabric piece and a second single back elastic fabric piece, with the first and second back elastic fabric pieces being coupled about a vertical midline at a back of the body shaping layer, with left and right outer sides of the front elastic fabric piece being coupled to outer sides of the first and second back elastic fabric pieces to form outer side seams of the body shaping layer, with inner sides of a lower portion of the front elastic fabric piece being coupled to inner sides of lower portions of the first and second back elastic fabric pieces to form inner side seams that extend below a crotch area of the body shaping layer such that a bottomwear portion of the body shaping layer is formed, the set of body shaping elastic fabric pieces further includes a bust elastic fabric piece with a lower portion of the bust elastic fabric piece being coupled to an upper portion of the front elastic fabric piece and left and right sides of the bust elastic fabric piece being coupled to an upper portion of a side of each of the first and second back elastic fabric pieces; and wherein the set of body shaping elastic fabric pieces further includes an overlay body shaping elastic fabric piece that overlays the front elastic fabric piece about abdominal and pelvis areas of the wearer of the body shaping layer, with the overlay body shaping elastic fabric piece being configured with a tapering effect from the hip area of the wearer to the crotch area of the wearer.

13. The body shaping layer of claim 12, wherein the front overlay body shaping elastic fabric piece overlaid on the front body shaping elastic fabric piece are configured to collectively provide increased elasticity to shape the abdominal area of the wearer of the body shaping layer.

* * * * *